United States Patent [19]

Calzini

[11] 4,141,480

[45] Feb. 27, 1979

[54] FRICTION FILM DRIVING DEVICE FOR DEVELOPING MACHINE

[75] Inventor: Mario Calzini, Rome, Italy

[73] Assignee: O.M.A.C. Caprara S.a.s., Germignaga, Italy

[21] Appl. No.: 808,551

[22] Filed: Jun. 21, 1977

[30] Foreign Application Priority Data

Jun. 21, 1976 [IT] Italy ..... 50032 A/76

[51] Int. Cl.[2] ..... B65H 17/42

[52] U.S. Cl. ..... 226/25; 226/35; 226/119

[58] Field of Search ..... 226/113, 118, 119, 25, 226/35, 188; 242/55.01

[56] References Cited

U.S. PATENT DOCUMENTS

| | | | |
|---|---|---|---|
| 3,575,100 | 4/1971 | Krause | 226/189 X |
| 3,827,646 | 8/1974 | Nielsen | 242/55.01 |

FOREIGN PATENT DOCUMENTS

| | | | |
|---|---|---|---|
| 1034024 | 7/1958 | Fed. Rep. of Germany | 226/119 |

*Primary Examiner*—Richard A. Schacher
*Attorney, Agent, or Firm*—Remy J. VanOphem

[57] ABSTRACT

A friction driving device for film developing machines which comprises a number of side-by-side film supporting roller members each consisting of a cylindrical body provided with equally spaced apart flanges defining therebetween a driving surface, and a driving roller member. The supporting rollers are so arranged as to contact the driving roller upon a drawing action exerted on the film. The driving roller member comprises a sequence of equally spaced apart cylindrical body portions of larger diameter with alternately equally spaced apart cylindrical body portions of smaller diameter having width approximately equal to the width of the driving surface of the supporting rollers and an outside diameter smaller than the diameter of the cylindrical body diameter of the driving surface of the supporting rollers. The driving roller is arranged so that each larger cylindrical body portion faces the driving surface on the supporting roller and each cylindrical body portion of smaller diameter faces the adjacent flanges of two side-by-side supporting roller members.

7 Claims, 2 Drawing Figures

FRICTION FILM DRIVING DEVICE FOR DEVELOPING MACHINE

BACKGROUND OF THE INVENTION

1. Field of the Invention

The present invention relates to motion picture developing machines and, more particularly, to the field of the several friction drive systems at present used and which are commonly referred to, in the prior art as, "bottom-drive", "weighted bottom-drive", "tendency drive", and "demand drive".

2. Description of the Prior Art

The driving mechanism for propelling film through the various treating baths which are used in motion picture developing machines is typically a sprocket and tooth arrangement; the teeth engaging the film perforations, or a friction drive arrangement relying upon the adhesion between the film and the driving rollers.

These known friction driving systems for motion picture film developing machines are affected by various practical and functional drawbacks, above all with respect to the coupling of the film supporting rollers with the driving rollers, said rollers being the essential driving components of all the prior art developing machines. The operation of these conventional prior art machines does not entail specific drawbacks as long as the velocity of the film is kept moderately low. On the contrary, because of the reliance upon friction to drive these prior art devices, serious problems occur whenever the film velocity exceeds certain limits.

SUMMARY OF THE INVENTION

The invention is a friction drive device for film developing machines which utilizes, in conjunction with a plurality of supporting rollers, a driving roller arrangement not of a constant diameter along its entire length. The driving roller is comprised of a sequence of equally spaced apart cylindrical portions of larger diameter which alternate with equally spaced apart cylindrical portions of smaller diameter. The cylindrical portions of larger diameter act upon the supporting rollers in such way that the surface contact between the two rollers is greatly increased, resulting in driving efforts 7 to 8 times higher than previously obtained in prior art friction driving devices without the need of varying other input parameters.

It is an object of the present invention to provide a device suitable for overcoming the drawbacks presented by the conventional friction type developing machines, thereby achieving distinct advantages over the prior art machines, which shall become apparent from the following description.

DETAILED DESCRIPTION OF THE PREFERRED EMBODIMENT

Figure 1:
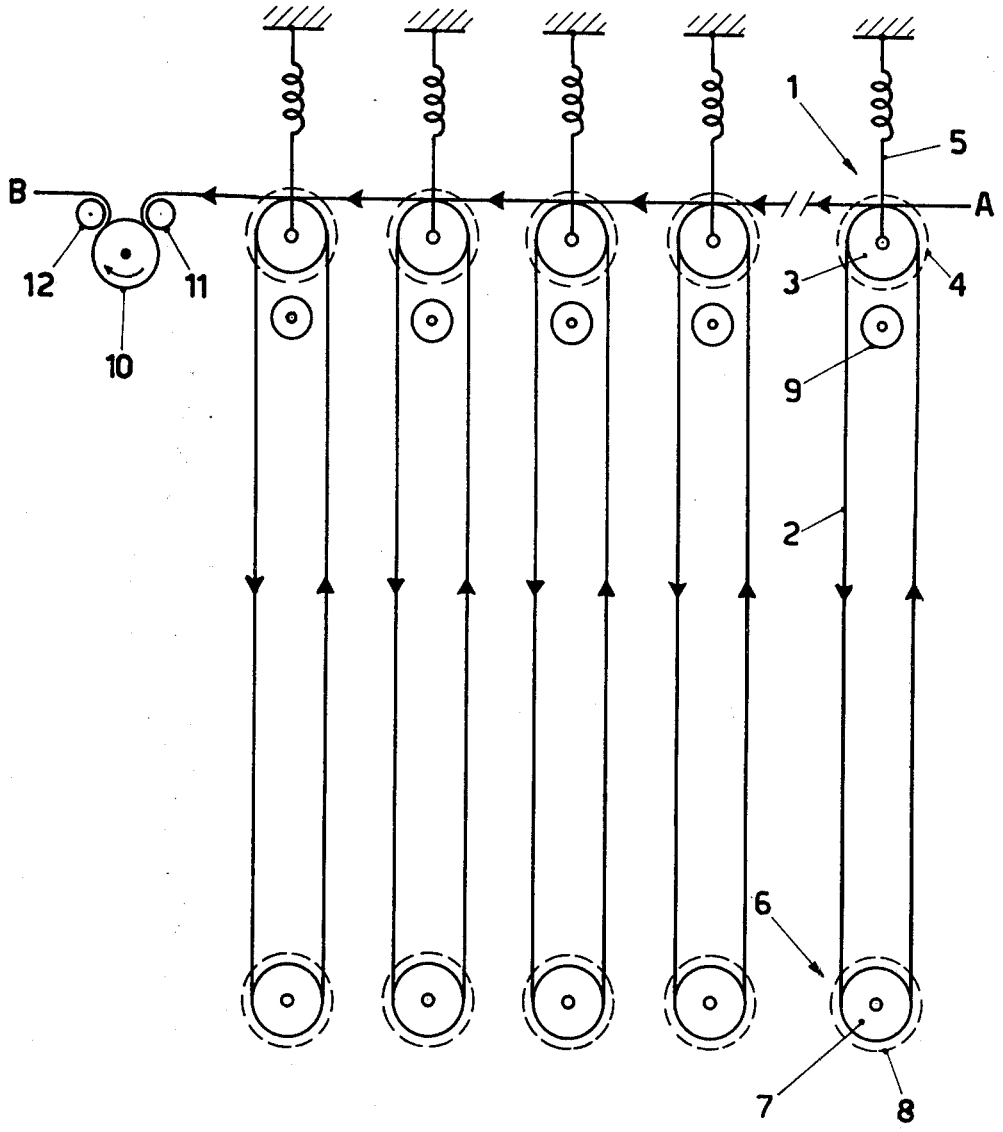
FIG. 1 is a schematic view of a conventional prior art apparatus embodying the "demand-drive" system.

For a clearer understanding of the advantages which the present embodiment achieves over the prior art devices, reference is made to FIG. 1 to describe the structure of a drive mechanism in its simplest schematic form, as well as the operation of a conventional film driving device embodying the "demand-drive" system for a film developing machine.

Generally designated by the reference numeral 1, is an upper support roller for supporting the film 2. The upper support roller comprises a cylinder 3 provided with three circular flanges 4; two flanges being placed laterally, and the third flange being in an intermediate position in such a way as to form a roller provided with two grooves.

The upper support roller 1 is connected to a spring support 5 so constructed as to be movable in a vertical direction only.

Generally designated by the reference numeral 6, is a lower roller for supporting the film 2, comprising a cylinder 7 provided with two flanges 8, one flange on each side face of the cylinder.

In proximity to the upper support roller 1 is a driving roller 9 which can be rotated in the direction shown by the arrow by any known suitable actuating means.

To simplify the following discussion, each unit comprising the above described components will hereinafter be referred to as a "driving assembly".

The apparatus shown in FIG. 1 comprises a number of driving assemblies arranged in sequence at a distance from each other, each driving assembly or group of driving assemblies corresponding to a different developing bath (not shown) for processing the motion picture film.

Following a sequence of driving assemblies is typically a drawing roller designated by the reference character 10 and generally referred to as a step roller. The step roller 10 is in driving relationship with a pair of film guide rollers 11 and 12.

The step roller 10 is caused to rotate in the direction shown by the arrow. The step roller, in conjunction with the guide rollers, receive the film from the last driving assembly, thus determining the film advancement velocity.

In operation, the film 2 travels from point A towards point B by first being passed over the first driving assembly. The film 2 is threaded in a first groove of the upper supporting roller, descends to the lower supporting roller 6, and is guided in a groove of the lower supporting roller and then re-ascends to be passed along a second groove within the upper supporting roller. This path defines a first loop.

From the second groove of the upper supporting roller 1 of the first driving assembly, the film is caused to advance toward a subsequent driving assembly on which it is wound in the same way as previously described, thus forming a second loop, and so on, until the last driving assembly from which the film 2 leaves the second groove of the upper supporting roller 1 in the direction of the step roller 10. The film is then threaded over the first guide roller 11, passed between the step roller 10 and the guide roller 11, around the step roller, and then between said step roller 10 and a second guide roller 12.

When the film 2 is arranged as hereinbefore described, rotation of the step roller 10 is initiated, thus drawing the film towards point B. Such drawing action causes a tension on the film and creates a "hoist-effect" of the film loop on the last driving assembly (i.e., the driving assembly seen at left in FIG. 1). This "hoist-effect" tends to lower the upper supporting roller 1, due to the tension force on the spring support 5, until eventually the flanges 4 of said upper supporting roller contact the driving roller 9. The driving roller having been previously actuated, is caused to rotate in the direction shown by the arrow. The driving roller 9 coming into contact with the flanges of the upper supporting roller causes a rotary motion to be initiated to the upper supporting roller which, in turn, exerts a driving action on the film to be placed upon the roller. This, obviously, results in a drawing action or tension force being exerted on the horizontal portion of the film 2 between the last driving assembly and the next preceding assembly, thereby causing the upper supporting roller of the next preceding assembly to lower, coming into contact with the driving roller 9, and this same reaction continues for each driving assembly until all driving assemblies are actuated.

Although the peripheral velocity of the step roller 10 is normally lower than the velocity of the driving roller 9, a balanced condition is caused to exist because of occasional slippage between the upper supporting roller 1 and the driving roller 9. The slippage between the supporting roller and the drive roller results in a balanced condition existing whereby the driving assembly maintains the peripheral velocity of the step roller 10.

In practice, in the "demand drive" developing machines, each driving assembly comprises a frame on which are arranged, keyed on respective rotation shafts in a side-to-side relationship, a number of upper supporting rollers 1 and lower supporting rollers 6, as well as a driving roller 9 extending below and running the whole length of the series of upper supporting rollers 1. This arrangement permits a longer length of film to be wound on said rollers in such a way as to form a series of side-by-side arranged loops for immersion in the developing baths.

The operation of these conventional machines does not entail particular drawbacks as long as the operational velocities are kept moderately low. On the contrary, serious problems arise whenever the film velocity exceeds certain predetermined limits.

It is apparent, that, for the machine to operate properly, the tension acting on the film should neither fall below a given value, nor exceed a dangerous limit. The minimum tension is that necessary to insure the correct film positioning on the supporting rollers during the film drawing, without film slackening which might cause the film to work its way out of the grooves of the supporting rollers.

In order to draw the film at a given velocity, it is necessary to overcome the friction of the supporting rollers and the advancement resistance of the film through the developing baths, as well as some additional resistances caused by the presence of various in-line machine accessories.

The drawing effort is a resultant of the friction of the driving rollers 9 on the flanges 4 of the upper supporting rollers 1. As with any friction force, this can be broken down into three factors; the force exerted by the roller 1 while urging against roller 9; the contact area between said rollers; and the condition of the surface of the two rollers.

As the machine velocity increases, frictional forces, naturally, increase along an approximately quadratic relationship and, consequently, the drawing effort must proportionately increase. However, since two of the three parameters determining the drawing effort (i.e., contact area and surface condition) cannot be readily changed, the pressure of the upper supporting roller on the driving roller is the only parameter which must necessarily increase. In order to obtain the increased pressure, the film tension must be increased in that, as a consequence of the system operation, the film tension determines the pressure between the upper supporting roller and the driving roller.

It is apparent that the increase of the film tension cannot exceed certain limits, without resulting in serious drawbacks, such as film warping or distortion, tearing of splices, and eventually, tearing of the film itself.

Experimental tests have shown that a proper tension on the film should not exceed 700–800 grams/loop and, therefore, about 350–400 grams/length. Whenever the film velocity does not exceed 2,000 meters/hour, the foregoing tension values can be easily attained, by causing the friction to be reduced to a minimum (e.g., by using ball bearings) although, in practical machine operations, it is not easy to maintain low friction values.

Whenever the film velocity exceeds 2,000 meters/-hour, some difficulties do arise, particularly in the case of machines of more up-to-date design wherein all the rollers are immersed in the treating baths and, consequently, the film need not leave the bath while passing from one driving assembly to the next, thus avoiding oxidation.

In fact, in such a case, the contact area between the supporting rollers 1, and the driving roller 9, is lubricated by the liquid, with attendant reduction of the friction coefficient determining the driving effort.

If additional decreases of film tension are desired, it is necessary to look for adjustments of the two remaining parameters, that is, contact area and surface condition, in order to effect the friction between rollers 1 and 9, thereby reducing the driving effort.

Choosing a suitable material to effect the nature of the contacting surface is not as easy as may be readily apparent. Actually, the use of a driving roller 9 of a rubber layer improves the adhesion and assists in increasing the driving effort, film tension being equal; however, soft materials are more strongly subject to wear and, therefore, bring about maintenance problems. Selection of other materials is not easily accomplished because, considering the fact that the driving assemblies are immersed in various treating baths, chemical inertness of the substances used must be insured. Efforts were then made to effect the type of contact surface between the upper supporting roller 1 and driving roller 9 and, to descend, supporting rollers 1 were designed having flanges provided with a knurled surface which, upon engagement with material of the driving rollers, brings about a higher driving effort.

This design, however, presents other serious drawbacks. As stated hereinabove, the proper driving operation depends on the continuous sliding of roller 1 upon roller 9 to compensate for the peripheral velocity of the step roller 10 which is lower than the velocity of the supporting rollers 1 (on the bearing diameter). The knurl on the flanges of the upper supporting roller 1 brings about an axial engagement (as if between two meshed gears) between roller 1 and roller 9. This engagement, having regard to the system operation, takes place at intervals resulting in a discontinuous (jerky) film advancement and subjecting the film to sudden and dangerous stresses. Besides, the knurl on the flanges on the supporing roller 1 causes two further disadvantages; firstly, it wears the driving roller 9 by digging indentations which alter the roller diameter and consequently, the driving characteristics of the total system. Also, secondly, the knurl itself will wear with time and lose its original driving ability.

The third parameter, that is, the area of the contact surface between the supporting rollers 1 and the driving roller 9, is therefore, left for consideration.

Theoretically, this area is the generating line formed by the contact of the two cylinders. This area is defined as the line generated between the surface of roller 9 and the outer surface of the edge of the flanges 4 of the upper supporting rollers 1. In practice, because of the elasticity of the materials, such contact encompasses an area which increases in direct proportion to the increase in pressure between the two rollers, as well as the increase in softness of the material. Since, as stated hereinabove, the materials must not be too soft and pressure should not exceed a certain limit, one can understand that the theoretical contact generating line of the flanges will decrease as the contact area decreases. An approach to obtaining this result is to eliminate the rounded shaped flanges of the supporting roller in contact with the driving roller 9. This can be accomplished by making longer the terminal free edge of each flange 4 of the supporting roller 1 resorting to an outwardly cylindrical portion.

A first achievement is thus attained which is, however, partial and unsatisfactory with machines provided with a plurality of rollers on each frame. Indeed, the provision of such cylindrical portion causes an increase of the step between a roller and the next roller, thus resulting in frames and, consequently, in machines which are bulkier, more expensive and less handy in bringing about a larger distance between centers from loop to loop resulting in more difficult film advancement.

Figure 2:
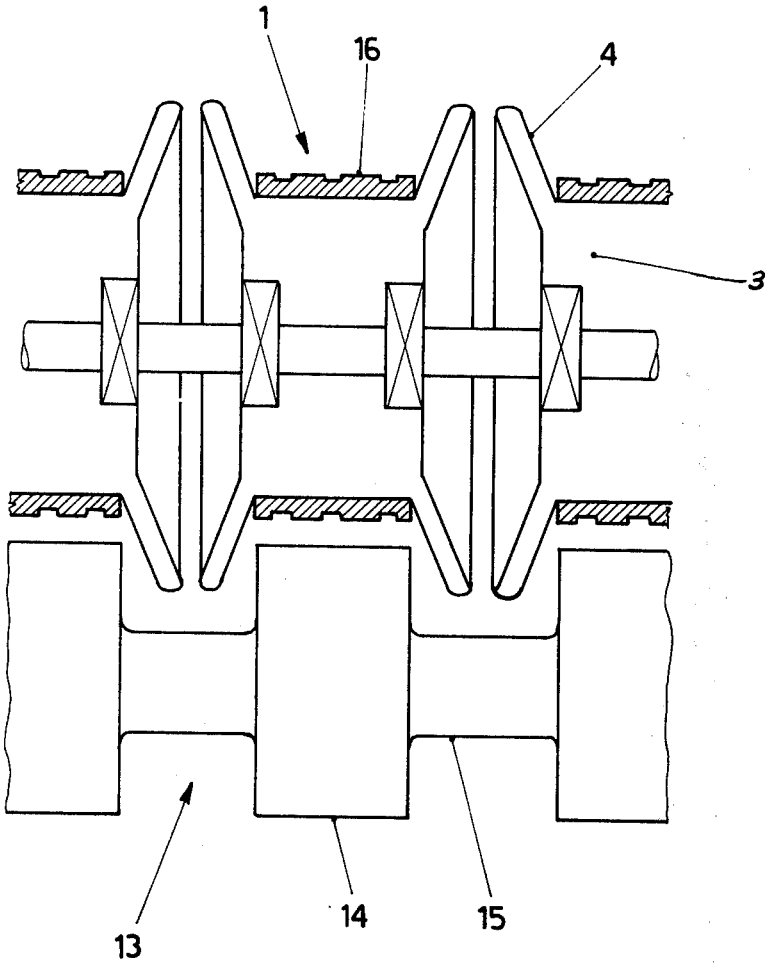
FIG. 2 is a partial cross sectional plan view of the upper supporting roller arrangement and driving roller, according to the present invention.

On the basis of the foregoing remarks, the driving device of the present invention which is illustrated in FIG. 2 is hereby disclosed.

With reference to FIG. 2, like elements as those previously described shall be designated by the same reference numeral.

From FIG. 2, it can be seen that the basic structure of each upper supporting roller 1 has remained unchanged, i.e., it comprises a cylindrical body 3 provided with equally spaced flanges 4 forming therebetween the groove for receiving the film.

The driving roller designated with reference numeral 9 in the description of FIG. 1 is replaced by a specially formed cylindrical shaped body generally designated with reference numeral 13 in FIG. 2. This driving roller 13, differently from the driving roller of a conventional machine, is not of a constant diameter along its entire length, but comprises a sequence of equally spaced apart cylindrical portions wherein a portion of larger diameter 14 alternates with a portion having a smaller diameter 15. Each cylindrical portion 14 of the driving roller 13 having a larger diameter is positioned in such a way as to face the groove of a supporting roller 1. The cylindrical portion 15 having a smaller diameter faces the adjacent flanges 4 of two contiguously arranged upper supporting rollers 1.

As a consequence of such arrangement, when each spring supporting roller, upon the drawing action exerted by the step roller 10 on the film 2, lowers onto the driving roller 13 the edges of the flanges 4 shall no longer contact the driving roller 13, as it occurs in the conventional machine, but the contact shall take place between the cylindrical portion 14 of the driving roller 13 having a larger diameter and the grooves of the supporting rollers 1. Each flange 4 of the supporting roller 1 will be free to rotate in the zone defined between two adjacent portions 14 of larger diameter, in correspondence with a portion 15 of smaller diameter. It should be noted that it is necessary that the diameter of each portion 14 of the driving roller 13 be smaller than the diameter of the cylindrical body 3 of the upper supporting roller 1 to cause the larger diameter portion 14 of the driving roller to contact the corresponding groove of an upper supporting roller 1 at the zone where the film does not lie on said roller, i.e., where the groove surface is free.

It is preferred to provide each groove of the supporting rollers 1 with a flat-type sleeve 16, preferably made of an elastic material and, even more preferably of an elastic soft material and, particularly, in order to fully exploit the foreseen adhesion condition, it is advisable that the sleeve shown in FIG. 2 and designated with the reference numeral 16 consist of a rubber ring provided with circumferentially extending grooves parallel to the film axis. By utilizing the complete contact surface of the upper supporting member between the two flanges of the roller, a contact surface of some centimeters is obtainable as compared to the contact surface of a few millimeters between the flanges of the upper supporting members and the drive rollers of prior art devices.

Since, generally, the "demand drive" machines cannot accommodate a plurality of film sizes, i.e., they can work upon 35, 16, 2 × 16, 2 × 8, 4 × 8, super 8, etc. films, the width of the grooves of supporting roller 1 is almost always about 35.5 millimeters. Therefore, in contrast with the few millimeters of the supporting width defining of the flanges of the supporting rollers and the driving rollers obtainable with conventional machines, by the device of the present invention supporting width of the order of 30 to 32 millimeters can be obtained without experiencing any drawbacks.

Holding all of the other parameters (such as nature of surfaces and pressure between supporting and driving rollers) out of consideration, one can obtain a driving effort 7 to 8 times higher than prior art devices (which then results in the possibility of decreasing by 7 to 8 times the maximum tension on the film). It should be noted that, by the device according to the present invention, the following favorable advantages also arise:

a) the contact between the supporting rollers and the driving roller 13 tends to keep clean the film bearing surface, thus achieving a distinct advantage as to the film physical quality and machine maintenance;

b) the film can rest in the grooves of the supporting rollers on variously shaped, soft rubber sleeves which promote the adhesion between the driving rollers 13 and the supporting roller 1. Such sleeves shall have to be changed as soon as their surface presents damages caused by the chemical action of the developing baths, but, although this maintenance is in any case necessary, maintenance operations are not further increased as a consequence of the contact between the driving and supporting rollers. Besides, to a certain extent, the cutting action of the flanges is no longer present, even in the presence of soft rubber, there is no risk that indentation in the roller may occur.

Although the application of the device according to the present invention has been exemplified with reference to a "demand-drive" type developing machine, it should be noted that the present device could be advantageously applied to any friction driving developing machine which should be obviously provided with the known accessories needed in connection with the adopted driving system.

The present invention is not confined to the described embodiment, but encompasses also any change and modification thereof falling within the spirit and scope of the invention.

What I claim is:

1. A friction device for film developing machines comprising:

a shaft;

a plurality of supporting roller members mounted coaxial with said shaft for supporting said film, said plurality of roller members further mounted side-by-side, each of said roller members comprising a cylindrical body having spaced apart flanges defining a cylindrical driving surface therebetween;

a driving roller member mounted adjacent said plurality of supporting roller members for communication therewith, said driving roller member comprising a plurality of cylindrical body portions alternately spaced with a plurality of reduced body portions, said plurality of cylindrical body portions positioned to communicate with the cylindrical driving surface between said flanges of each of said plurality of roller members, said plurality of cylindrical body portions further comprising an outside diameter smaller than the outside diameter of said cylindrical driving surface of the plurality of supporting roller members, said plurality of reduced body portions of said driving roller members adapted to receive at least one flange of each of said two side-by-side mounted supporting roller members;

means for bearing interposed said plurality of supporting roller members and said shaft; and actuating means mounted in driving relationship with said driving roller member for actuating said driving roller member whereby upon a drawing action of the film the cylindrical driving surface of said plurality of supporting roller members engages said cylindrical body portions of the driving member while the adjacent flanges of the two contiguous supporting rollers are free to rotate within the reduced body portion of the driving roller member.

2. The friction device as claimed in claim 1 wherein said cylindrical body portion of the plurality of roller members further comprises an outside diameter having an axial length substantially the same as that of the cylindrical driving surface.

3. The friction device as claimed in claim 1 wherein said cylindrical driving surface of the plurality of supporting roller members further comprises at least one circumferential groove radially inward of said cylindrical driving surface for supporting said film.

4. The friction device as claimed in claim 1 further comprising a plurality of cylindrical sleeve members mounted coaxial with said driving surface of the plurality of supporting roller members for rotation therewith, each of said plurality of cylindrical sleeve members having at least one circumferential groove formed radially inward of said cylindrical sleeve member outer surface for receiving said film.

5. The friction device as claimed in claim 2 wherein said cylindrical driving surface of the plurality of supporting roller members further comprises at least one circumferential groove radially inward of said cylindrical driving surface for supporting said film.

6. The friction device as claimed in claim 4 wherein each of said plurality of cylindrical sleeve members have an axial length substantially equal to the axial length of said cylindrical driving surface of the plurality of supporting roller members.

7. The friction device as claimed in claim 4 wherein said plurality of cylindrical sleeve members outer diameter is smaller than the outer diameter of said cylindrical driving surface of said plurality of supporting roller members.

* * * * *

UNITED STATES PATENT AND TRADEMARK OFFICE

CERTIFICATE OF CORRECTION

PATENT NO. : 4,141,480

DATED : February 27, 1979

INVENTOR(S) : Mario Calzini

It is certified that error appears in the above-identified patent and that said Letters Patent are hereby corrected as shown below:

In the ABSTRACT, line 10, delete the word "larger" and insert therefore the word ----smaller----.

In the ABSTRACT, line 11, delete the word "smaller" and insert therefore the word ----larger----.

Column 4, line 63, delete the word "supporing" and insert therefore the word ----supporting----.

Signed and Sealed this

*Tenth* Day of *July 1979*

[SEAL]

*Attest:*

*Attesting Officer*

LUTRELLE F. PARKER

*Acting Commissioner of Patents and Trademarks*